US006857837B2

(12) United States Patent
Rajewski

(10) Patent No.: US 6,857,837 B2
(45) Date of Patent: Feb. 22, 2005

(54) UTILITY POLE INSTALLATION SYSTEM

(76) Inventor: Robert C. Rajewski, R.R. #1, Donalda, Alberta (CA), T0B 1H0

( * ) Notice: Subject to any disclaimer, the term of this patent is extended or adjusted under 35 U.S.C. 154(b) by 73 days.

(21) Appl. No.: 10/058,969

(22) Filed: Jan. 30, 2002

(65) Prior Publication Data

US 2003/0133772 A1 Jul. 17, 2003

(30) Foreign Application Priority Data

Jan. 16, 2002 (CA) ..... 2367805

(51) Int. Cl.[7] ..... B66G 11/00
(52) U.S. Cl. ..... 414/23; 37/323
(58) Field of Search ..... 414/23, 27; 37/301, 37/302, 317, 322, 323

(56) References Cited

U.S. PATENT DOCUMENTS

| | | | | | |
|---|---|---|---|---|---|
| 491,748 | A | * | 2/1893 | Urie | 37/318 |
| 3,630,243 | A | * | 12/1971 | Hamilton et al. | 144/163 |
| 3,631,991 | A | | 1/1972 | Wacht et al. | 214/3 |
| 4,067,369 | A | * | 1/1978 | Harmon | 144/34.1 |
| 4,362,451 | A | * | 12/1982 | Thiermann | 414/23 |
| 5,016,717 | A | | 5/1991 | Simons et al. | 175/66 |
| 5,425,188 | A | * | 6/1995 | Rinker | 37/317 |
| 5,450,912 | A | * | 9/1995 | Cahill et al. | 175/57 |
| 5,487,228 | A | * | 1/1996 | Marazzo et al. | 37/317 |
| 5,876,174 | A | * | 3/1999 | Arsenault | 414/460 |
| 6,273,512 | B1 | * | 8/2001 | Rajewski | 299/17 |
| 6,453,584 | B1 | * | 9/2002 | Buckner | 37/323 |
| 2002/0119030 | A1 | * | 8/2002 | Hensler | |

OTHER PUBLICATIONS

Terex Telelect product brochures, 6 pages, believed to be dated Sep., 2000.

Canadian Patent Application 2,317,667, filed Sep. 6, 2000, published Mar. 8, 2001.

American Hydrovac & Excavation product brochure, 3 pages, dated May, 1999, date indicated is when equipment shown in brochure was used in the United States for utility pole digging according to person at company.

* cited by examiner

*Primary Examiner*—Donald W. Underwood

(57) ABSTRACT

A utility pole installation system, comprising a hydrovac unit having a chassis and a utility pole positioner mounted on the chassis. The hydrovac unit has an internal combustion engine mounted on the chassis, and a hydrovac boom mounted on the chassis. A hydraulic power supply mounted on the chassis is powered by the internal combustion engine and used to power both the hydrovac boom and the utility pole positioner.

1 Claim, 1 Drawing Sheet

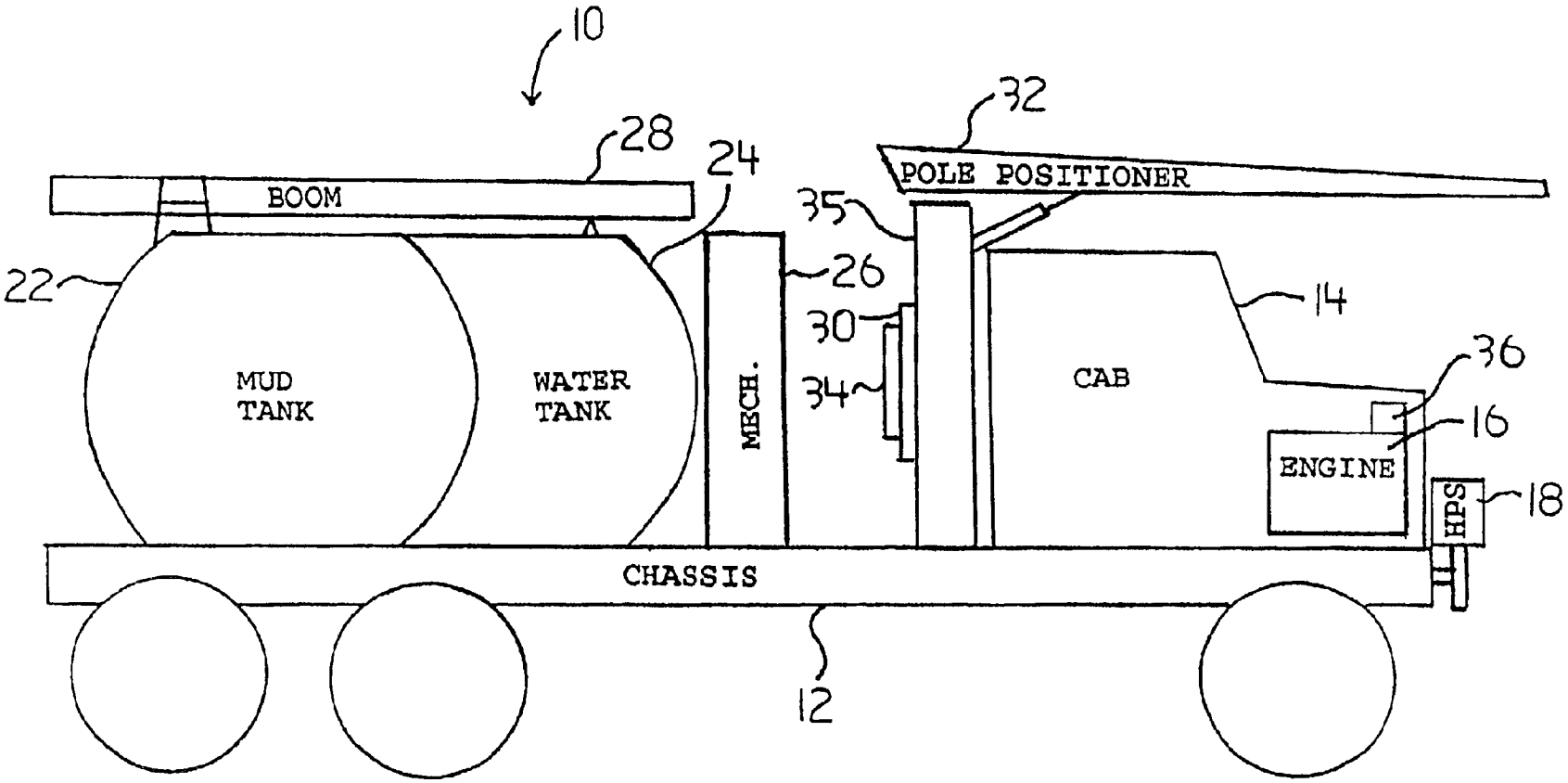
FIGURE

UTILITY POLE INSTALLATION SYSTEM

BACKGROUND OF THE INVENTION

In hydrovac operations, water jets from a hose mounted on a hydrovac truck are used to blast a hole or trench in soil and the fluidized soil thus created is sucked into a mud tank mounted on the truck. Canadian patent application no. 2,317,667 published Mar. 8, 2001, describes an example of such a hydrovac truck. A particular use of hydrovac units is to dig holes for utility poles. The hydrovac unit digs the hole and then a conventional pole truck is used to place the pole in the hole. Conventional pole trucks are also known that may be provided with augers for digging holes, but the use of augers is disliked in the utility industry due to the risk of severing a pipe or other utility conduit. A representative of a utility company has complained about the absence of a pole positioner with hydrovac capability. Hitherto, hydrovac companies have not produced such a device.

SUMMARY OF THE INVENTION

The inventor has recognized that using separate trucks for water jetting the hole and placing the pole in the hole is disadvantageous, being expensive and difficult to coordinate. The inventor has thus proposed a solution to the difficulty, and recognized that a combination unit with pole positioner and hydrovac unit is feasible.

There is therefore provided in accordance with an aspect of the invention, a utility pole installation system, comprising a hydrovac unit having a chassis and a utility pole positioner mounted on the chassis. The hydrovac unit has an internal combustion engine mounted on the chassis, and a hydrovac boom mounted on the chassis. According to a further aspect of the invention, a hydraulic power supply mounted on the chassis is powered by the internal combustion engine and used to power both the hydrovac boom and the utility pole positioner. According to a further aspect of the invention, the pole positioner is mounted between the cab and the mud tank of the hydrovac unit, preferably between the cab of the hydrovac unit and mechanical components of the hydrovac unit.

These and other aspects of the invention are described in the detailed description of the invention and claimed in the claims that follow.

BRIEF DESCRIPTION OF THE DRAWINGS

There will now be described preferred embodiments of the invention, with reference to the sole FIGURE by way of illustration only and not with the intention of limiting the scope of the invention.

DETAILED DESCRIPTION OF PREFERRED EMBODIMENTS

In this patent document, "comprising" means "including". In addition, a reference to an element by the indefinite article "a" does not exclude the possibility that more than one of the elements is present. A "hydrovac unit" as used herein comprises the necessary conventional components, some of which are for example described herein, to make a hydrovac unit work. A "pole positioner" as used herein likewise comprises the necessary conventional components, some of which are for example described herein, to make a pole positioner work. When the word "mounted" is used, the item may be mounted directly or indirectly on the object referred to.

Referring to the figure, there is shown a utility pole installation system. A conventional hydrovac unit 10 has a chassis 12, on the front of which is mounted a cab 14 and a conventional internal combustion engine 16. A conventional hydraulic power supply 18 is mounted on the front of the chassis 12, at the bumper 20. The hydraulic power supply 18 is powered by the engine 16 in conventional fashion. On the rear of the chassis 12 is mounted a mud tank 22, water tank 24 and mechanical components 26 for the mud tank 22 and water tank 24. The mechanical components 26 include such conventional components as a blower, air filter, vacuum breaker, water pump and silencer, all of which are known in the art and used in conventional hydrovac units. A boom 28 is mounted on the mud tank 22. The boom 28 carries the conventional hose (not shown) that is used to dig holes for placing utility equipment such as utility poles. Controls (not shown) for the mud tank 22, hose and boom 28 may be mounted on a panel 30 at the rear of the chassis 12, or the boom controls may be located on the wand, as disclosed in U.S. Pat. No. 6,237,512. Such hydrovac units 10 or the like may be purchased from any one of a number of companies such as Tornado Advanced Systems Corp. of Stettler, Alberta, Canada.

A utility pole positioner 32 is also mounted on the chassis 12 of the hydrovac unit 10. Preferably, the utility pole positioner 32 with its conventional support 35 is mounted directly on the chassis 12 between the cab 14 and mud tank 22, by any of various conventional means such as bolts and welding. Preferably, the pole positioner 32 is mounted between the cab 14 and the mechanical components 26 of the hydrovac unit 10. Conventional utility pole positioners 32 are usually hydraulically powered and the pole positioner 32 is connected to the hydraulic power supply 18 in conventional fashion to power the pole positioner 32. The pole positioner 32 also has conventional controls 34, which are preferably mounted on a panel 30 on the conventional pole positioner support 35, or may be mounted with the hydrovac unit controls. Alternatively, the pole positioner 32 may be driven by an electrical power supply 36 of the hydrovac unit 10. The pole positioner 32, its support 35 and controls 34 are all conventional and available for example from Terex Cranes Inc. of South Carolina, USA, such as the Telelect™ utility aerial equipment digger derricks, 4000 and 5000 series.

A person operating the utility pole installation system described herein stands at the rear of the hydrovac unit, and operates first the hydrovac unit 10 and then gets up onto the hydrovac unit behind the cab 14 and operates the pole positioner 32. Typically, the hydrovac unit 10 and pole positioner 32 are operated alternately, but may be operated concurrently as required until the pole is in place.

Immaterial modifications may be made to the invention described here without departing from the essence of the invention.

I claim:

1. A utility pole installation system, comprising:

a hydrovac unit having a chassis, the chassis having a front and rear, a mud tank mounted on the rear of the chassis and a cab mounted on the front of the chassis;

mechanical components for the hydrovac unit being mounted on the chassis between the cab and the mud tank; and a utility pole positioner mounted on the chassis of the hydrovac unit between the cab and the mechanical components.

* * * * *